US005112562A

United States Patent [19]

Mende

[11] Patent Number: 5,112,562

[45] Date of Patent: May 12, 1992

[54] METHOD AND APPARATUS FOR MANUFACTURING NONWOVEN FABRICS

[75] Inventor: Takayuki Mende, Kuga, Japan

[73] Assignee: Mitsui Petrochemical Industries, Ltd., Tokyo, Japan

[21] Appl. No.: 645,612

[22] Filed: Jan. 25, 1991

[30] Foreign Application Priority Data

Jan. 27, 1990 [JP] Japan ..... 2-17031

[51] Int. Cl.[5] ..... D01D 5/085

[52] U.S. Cl. ..... 264/555; 264/103; 264/210.8; 425/72.2; 425/73; 425/83.1

[58] Field of Search ..... 264/103, 555, 556, 176.1, 264/210.8, 211.14, 211.17; 425/72.2, 72.1, 192 S, 7, 73, 74, 75, 80.1, 83.1

[56] References Cited

U.S. PATENT DOCUMENTS 3,502,763 3/1970 Hartmann ..... 264/555
4,380,570 4/1983 Schwarz ..... 264/12
4,826,415 5/1989 Mende ..... 425/7
4,964,197 10/1990 Mente et al. ..... 264/555

*Primary Examiner*—Jill L. Heitbrink
*Attorney, Agent, or Firm*—Sherman and Shalloway

[57] ABSTRACT

Method and apparatus for manufacturing span bond nonwoven fabrics formed from continuous fibers which are small in fineness and high in strength and manufactured by the steps of spinning for obtaining a continuously drawn fiber by blowing a molten resin extruded out of a spinning nozzle by heated gases blown out of the periphery of the spinning nozzle; drawing for further drawing the obtained continuously drawn fiber by an air stream produced due to a pressure difference of gases; the extreme end of the nozzle being a distance of 0.5 to 2 m from the place where further drawing occurs; collecting for collection the drawn continuous fiber to collect the fibers; and uniting for uniting the collected continuous fibers together to form nonwoven fabrics.

11 Claims, 7 Drawing Sheets

METHOD AND APPARATUS FOR MANUFACTURING NONWOVEN FABRICS

BACKGROUND OF THE INVENTION

The present invention relates to a method for manufacturing nonwoven fabrics and apparatus for manufacturing the same. More specifically, the present invention relates to a method for manufacturing nonwoven fabrics particularly suitable for manufacturing nonwoven fabrics which are formed from extra fine fibers of which fineness is less than one denier.

A span bond method for hauling and drawing resins extruded from a nozzle by means of an air sucker is a method for manufacturing nonwoven fabrics with good productivity. In this method, generally, continuous fibers having a fineness of 1.5 denier or more are manufactured.

On the other hand, a melt blow method is employed as a method for manufacturing nonwoven fabrics of which fineness is less than one denier. According to this method, resins moved out of a nozzle are blown off by high speed heated gases blown out of gas orifices around the nozzle to obtain extra fine fibers.

In the above-described span bond method which hauls resins by the air sucker, when the resins having the fineness less than 1 denier are spun, cutting of yarns often occurs during spinning for the reasons hereinbelow, failing to achieve stabilized production.

More specifically, the molten resin extruded out of the nozzle first moves forward in substantially the same diameter as the bore diameter of the nozzle for a distance to some extent, and thereafter the resin suddenly becomes fine at a certain location and is drawn. Such a portion is called a neck. Such drawing of the molten resin extruded out of the nozzle is not carried out in the whole area of the spinning section but is rapidly carried out at the neck. Therefore, formation of finer resin becomes unstable as the ratio of fiber diameter before and behind the neck increases and as the gradient in change of section at the neck becomes severe.

A method for reducing a bore diameter of a nozzle is employed as a method for reducing the severe change of section before and behind the neck. However, this method has not been put to practical use due to the problems of processing technique of nozzles and blockage of nozzles by foreign matter. Therefore, it is difficult for the conventional span bond method to manufacture soft nonwoven fabrics formed from fibers of which finesness is less than one denier.

On the other hand, in the melt blow method, gases blown out of gas orifices have their initial speed of hundreds of meter/second but the speed thereof rapidly attenuates as the gases move away from the nozzle. Therefore, the fibers momentarily drawn and tensioned by the high speed gases are relieved from tension without being sufficiently cooled. Accordingly, the obtained fibers are small in strength. In addition, resin used are small in melting viscosity and small in molecular weight so that the resins may withstand the instantaneous high speed drawing as described above, and therefore they are originally poor in representation of strength.

For these reasons, nonwoven fabrics having a small fineness can be manufactured by the melt blow method but the obtained nonwoven fabrics is small in strength of fiber, say, ½, as compared with the previously described method using the air sucker. Furthermore, the fibers are not completely continuous but the length of fibers is from approximately 1 meter to several centimeters, in which is mixed a small lump of resins called a shot.

SUMMARY OF THE INVENTION

In view of the problems noted above with respect to prior art, the present invention provides a method for manufacturing span bond nonwoven fabrics formed from continuous fibers which is small in fineness and high in strength.

The present invention employed the following means in order to solve the aforementioned tasks.

More specifically, a method for manufacturing nonwoven fabrics according to the present invention comprises the steps of:

(1) spinning for obtaining a continuously drawn fiber by blowing a molten resin extruded out of a spinning nozzle by heated gases brown out of the periphery of the spinning nozzle;

(2) drawing for further drawing the obtained continuously drawn fiber by an air stream produced due to a pressure difference of gases;

(3) collecting for collecting the drawn continuous fiber to collect the fibers; and (4) uniting for uniting the collected continuous fibers together to form nonwoven fabrics.

Furthermore, an apparatus for manufacturing nonwoven fabrics according to the present invention comprises:

(1) a spinning nozzle having orifices for blowing out heated gases in the periphery of extrusion holes of molten resin and blowing the molten resin extruded out of extrusion holes by heated gases blown out of the orifices to subject the resin to primary drawing;

(2) a drawing device for subjecting a continuously drawn fiber spun from the spinning nozzle to secondary drawing at a pressure difference of gases;

(3) a collecting device for receiving the secondary drawn continuous fiber at a collecting surface to collect the fibers; and (4) a uniting device for uniting the collected continuous fibers together to form nonwoven fabrics.

In the method for manufacturing nonwoven fabrics according to the present invention, a continuously drawn fiber is first obtained. This spinning step corresponds to the melt blow method. However, short fibers are not obtained here but the molten resins extruded out of the spinning nozzle are continuously blown to obtain a continuously drawn fiber.

The obtained continuously drawn fiber is further drawn by the succeeding drawing step. The drawing step corresponds to hauling by an air sucker in the conventional span bond method. However, unlike the case of the span bond method, the extruded molten resin is not immediately drawn but the continuous fiber once already drawn in the aforementioned spinning step is again drawn so that no yarn-cutting due to the sudden drawing at the neck occurs and the drawing itself can be carried out in a stabilized manner.

From the foregoing, the present method has function and effect excelling in a mere combination of the melt blow method and the span bond method.

The continuously drawn fibers having been subjected to the drawing step are accumulated and collected on the collecting surface. Thereafter, the fibers are adhered or bonded together and united each other to form nonwoven fabrics.

DESCRIPTION OF THE PREFERRED EMBODIMENTS OF THE INVENTION

As resins used in the present invention, any resins can be generally used as long as they are used for the span bond method or the melt blow method which uses the air sucker. With respect to the viscosity of these resins, resin of low viscosity need not particularly be used. That is, the resin viscosity used is in the range of from 50 to 1000 poise.

In the method for manufacturing nonwoven fabrics according to the present invention, resins as described above are used, and for example, the nonwoven fabrics manufacturing apparatus as described below may be used to carry out the method.

Figure 1:
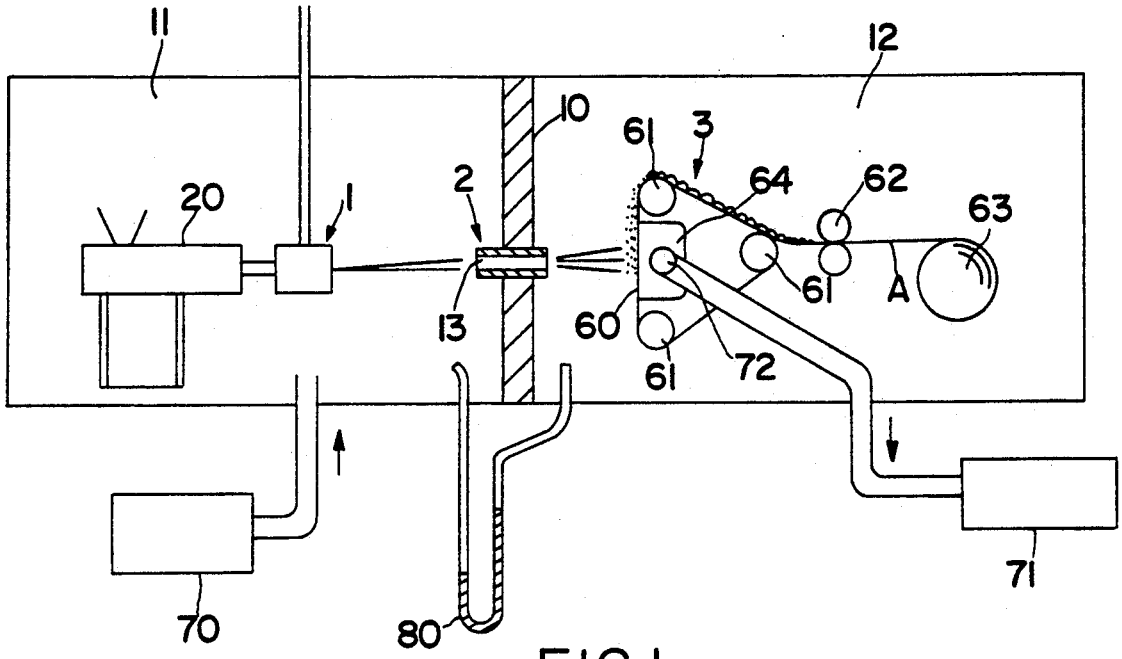
FIG. 1 is a view showing one example of apparatus according to the present invention.
Figure 3:
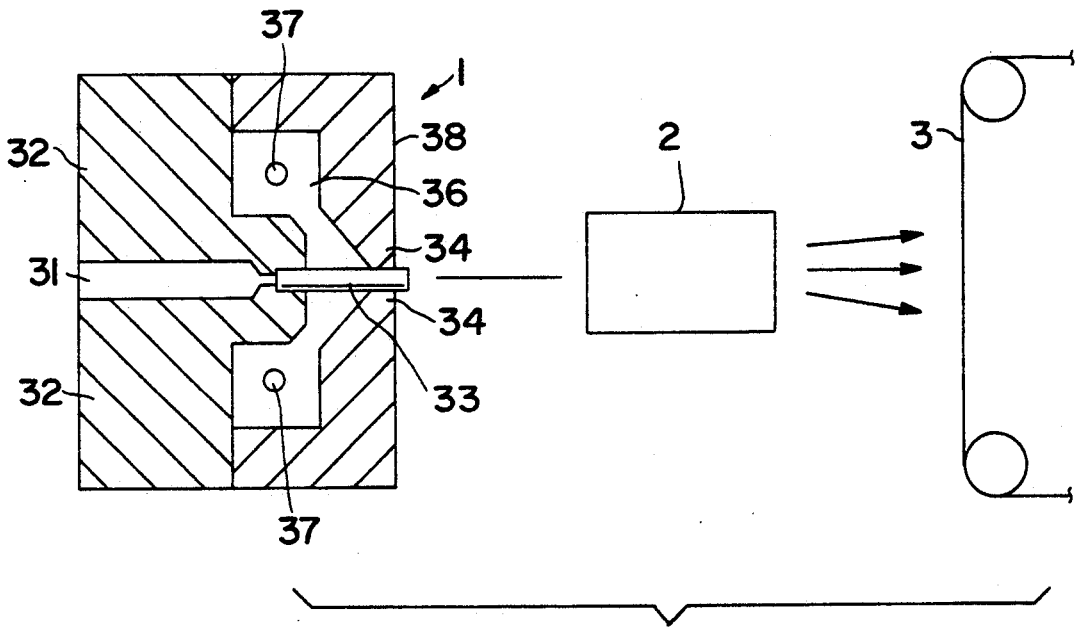
FIG. 3 is a sectional view of a spinning nozzle.

The apparatus shown in FIGS. 1 and 3 comprises a spinning nozzle 1 wherein orifices for blowing out heated gases are provided around extrusion holes for molten resins and the molten resins extruded out of the extrusion holes are blown by the heated gases blown out of the orifices to effect primary drawing, a drawing device 2 wherein continuously drawn fibers spun by the spinning nozzle 1 are subjected to secondary drawing by pressure difference of the gases, a collecting device 3 for receiving the continuous fibers subjected to secondary drawing to collect them, and a uniting device 62 for mutually uniting the continuous fibers collected by a heat emboss roll to form nonwoven fabrics.

In FIG. 1, the drawing device 2 has a high pressure chamber 11 and a low pressure chamber 12 between which is partitioned by a partitioning wall 10, said partitioning wall 10 being provided with a communication hole 13 by which the high pressure chamber 11 and the low pressure chamber 12 are communicated. The spinning nozzle 1 is positioned on the side of the high pressure chamber 11, and the collecting device 3 is positioned on the side of the low pressure chamber 12. The spinning nozzle 1 is connected to an extrusion opening of an extruding machine 20 provided interiorly of the high pressure chamber 11. The spinning nozzle 1 performs the spinning step, the communication hole 13 by which the high pressure chamber 11 and the low pressure chamber 12 are communicated performs the drawing step, the collecting device performs the collecting step, and the emboss roll 62 performs the uniting step.

FIG. 3 shows the case where the drawing device 2 comprises an air sucker. The air sucker will be described in detail later.

The method for obtaining nonwoven fabrics by the apparatus as described above will be described hereinafter referring to the respective steps.

(1) Spinning Step

The spinning nozzle 1 has orifices for blowing out heated gases around the extrusion holes for molten resins. It is suggested that the spinning nozzle 1 is normally provided with a plurality of extrusion holes so that a number of fibers can be simultaneously formed.

In the apparatus according to the present invention, the bore diameter of the extrusion hole of the spinning nozzle 1 is preferably small, 0.6 mm to 0.1 mm, more preferably, 0.4 mm to 0.1 mm.

The molten resin extruded out of the extrusion hole is blown by the heated gas blown out of the blowing orifices. The method for providing the orifices around the nozzle 1 is disclosed in Japanese Patent Application Laid-Open No. 63-227806, Japanese Patent Publication No. 44-22525, and Japanese Patent Application Laid-Open No. 56-159336.

Figure 4:
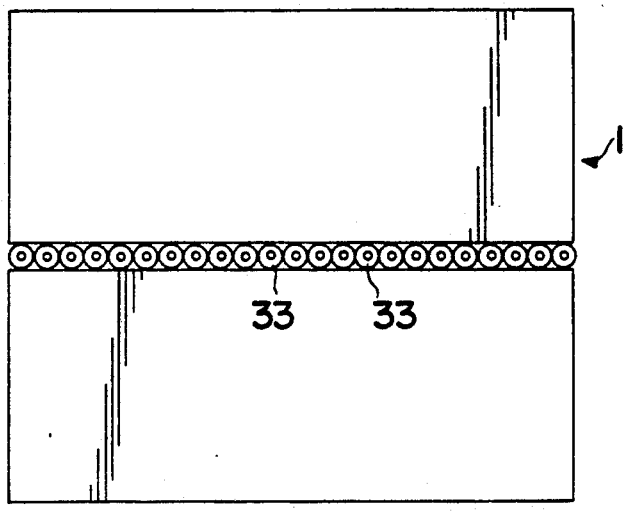
FIG. 4 is a front view of a spinning nozzle.
Figure 5:
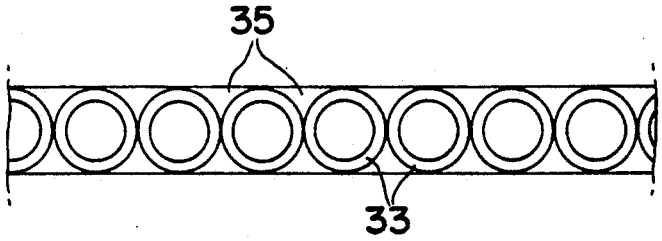
FIG. 5 is a partly enlarged view of capillary tubes and gas orifices.

As shown in FIGS. 3 to 5, the spinning nozzle 1 disclosed in Japanese Patent Application Laid-Open No. 63-227806 comprises a die block 32 having a resin chamber 31 for receiving molten resins to be extruded, a plurality of capillary tubes 33 of which base ends are held on the die block 32 in the state they form in a plane and communicated with the resin chamber 31, and a gas plate 38 which has a flat lip portion 34 at the extreme end thereof, the extreme end of the capillary tube 33 being held by a flat keep surface of the lip portion 34, orifices 35 for blowing gases formed between said keep surface and the peripheral surface of the capillary tube, a gas chamber 36 communicated with the gas blowing orifices 35 formed adjacent to the die block 32, and a gas inlet 37 for supplying gas into the gas chamber 36, the extreme end of the capillary tube 33 being projected from the lip portion 34. The molten resin from the extruding machine 20 is extruded out of the capillary tubes 33, blown by the flow of heated gases blown out of the orifices 35, hauled and subjected to primary drawing.

Figure 6:
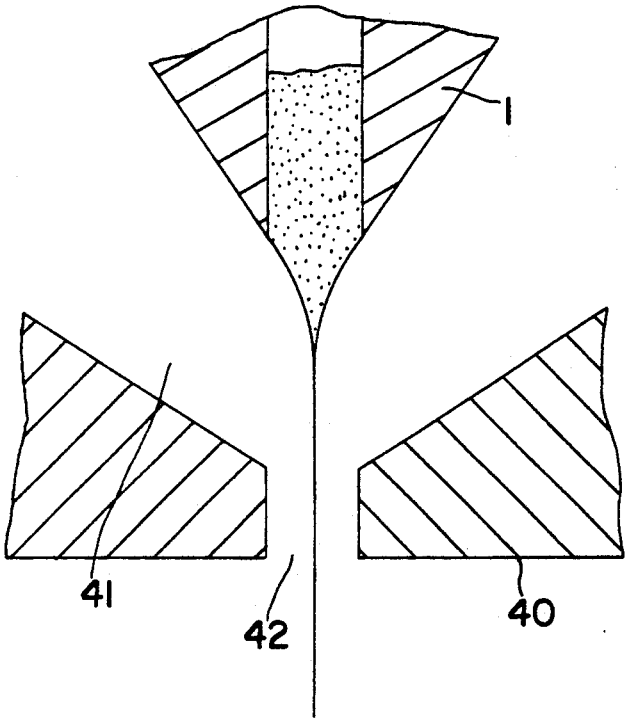
FIG. 6 is a sectional view of a further spinning nozzle.

As shown in FIG. 6, the spinning nozzle 1 disclosed in Japanese Patent Publication No. 44-22525 is designed so that the extreme end of the spinning nozzle 1 is surrounded by a block 40 to form a gas passage 41 between the nozzle 1 and the block 40, and an outlet 42 is provided in the block 40 so as to be opposed to the extrusion hole. The molten resin discharged out of the nozzle end is merged with the heated gas from the gas passage 41 to supply the continuous fiber from the outlet 42. The continuous fiber formed by the discharged molten resin is hauled by the gas flow and subjected to primary drawing.

Figure 7:
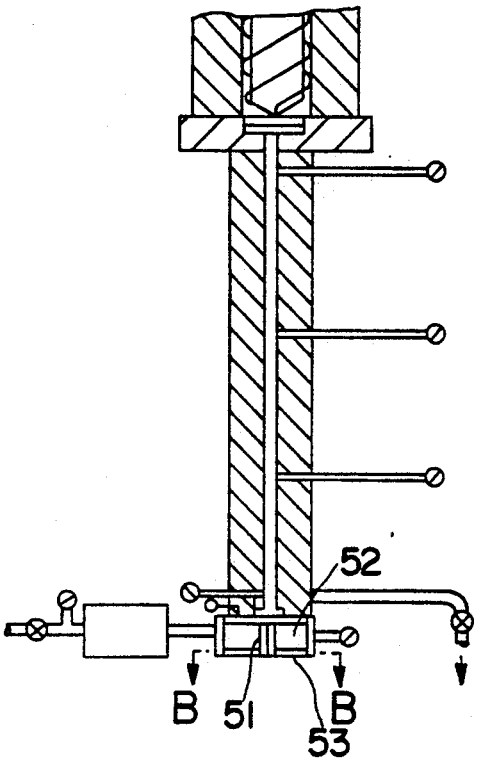
FIG. 7 is a sectional view showing a further spinning nozzle.
Figure 8:
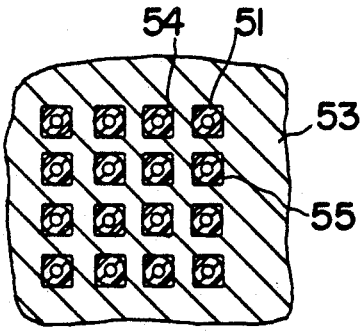
FIG. 8 is a sectional view taken on B—B of FIG. 7.

As shown in FIGS. 7 and 8, the spinning nozzle 1 disclosed in Japanese Patent Application Laid-Open No. 56-159336 is constructed so that a number of capillary tubes 51 for discharging molten resins are provided within a gas chamber 52, window holes 54 in the number corresponding to that of the capillary tubes 51 are provided in a front plate 53 of the gas chamber 52, the extreme end of each of the capillary tubes 51 being inserted into each of the window holes 54, and a gas discharging orifice 55 is formed between the capillary tube 51 and the window hole 54. The molten resin is extruded out of the capillary tubes 51, blown by the flow of heated gases blown out of the orifices 55, hauled and subjected to primary drawing.

It is important in the aforementioned spinning step that a conventional spinning nozzle for the melt blow can be used but that nozzle is not used similarly to the melt blow method to obtain short fibers but obtain a continuous fiber to subject it to primary drawing while spinning it.

In the spinning step, the speed of gas flow is adjusted so that the speed of the fibers blown and moved by the gas flow is less than 20 m/sec., preferably, less than 10 m/sec, and 1 m/sec. or more.

As gases used for high-speed stream to blow and move the resins, there can be mentioned, for example, such as air, carbon dioxide gas, nitrogen gas, which are gases inert agains molten resins. Out of them, air is preferable in consideration of economy.

The velocity (Vf) of fiber to be blown and moved is calculated by the following formula from the discharge quantity and the diamete of fiber.

$$Q = (\pi \div 4) \times Df \times Df \times Vf \times (60 \div 1{,}000{,}000) = \frac{\pi \times Df \times Df \times Vf \times 60}{4{,}000{,}000}$$

$$Vf = \frac{4{,}000{,}000 \times Q}{\pi \times Df \times Df \times 60}$$

where

Q: Discharge quantity of resin per minute per unit nozzle (cc/hole/minute)

Df: Diameter of fiber (μm)

Vf: Velocity of fiber (m/sec)

(2) Drawing Step

Next, the continuous drawn fiber obtained in the spinning step is subjected to secondary drawing in the drawing step. At this time, the hauling force may be adjusted so that the velocity of fiber is in excess of that when the secondary drawing does not take place by 1 m/sec. or more. By doing so, the fiber is always stretched from emergence from the spinning nozzle to the arrival to the drawing device, increasing a degree of molecular orientation. The molten resin immediately after emergence from the spinning nozzle is subjected to the primary drawing by the heated gases blown out of the orifices around the spinning nozzle and then subjected to the secondary drawing by the hauling force in the drawing device, and therefore, the spinning span to be a neck becomes extended, a grade of deformation of a section (fiber diameter) at the neck becomes gentle or the neck is divided into two parts, making it difficult to produce yarn-cutting.

The molten resin subjected to the primary drawing immediately after the spinning nozzle is large in specific surface area and high in cooling speed at that time, and therefore, cooling by cool air as in the conventional span bond method is not particularly required. In addition, the spinning distance can be shortened, and therefore, air resistance produced on the fiber surface during spinning is small to make it easy to control the drawing force so that yarn-cutting may be easily prevented.

As apparatus for the drawing step, apparatus can be used in which the communication hole 13 is provided in the partitioning wall 10 which partitions between the high pressure chamber 11 and the low pressure chamber 12, as shown in FIG. 1. The continuous fiber discharged out of the spinning nozzle 1 on the side of the high pressure chamber 11 and subjected to the primary drawing passes through the communication hole 13 and is sent toward the low pressure chamber 12. The continuous drawn fiber is subjected to the secondary drawing by an air stream produced in the communication hole 13 portion due to the pressure difference of gases between the high pressure chamber 11 and the low pressure chamber 12.

Figure 2:
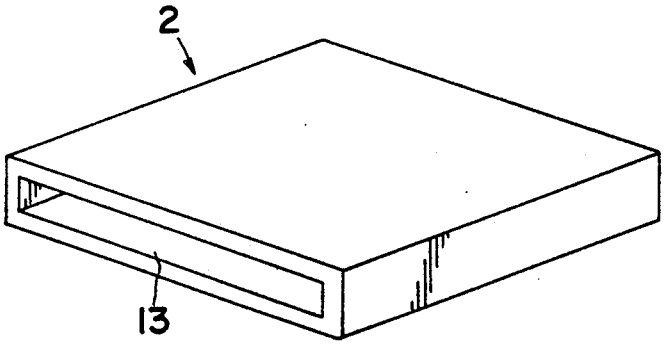
FIG. 2 is a perspective view of a communication hole portion.

The communication hole 13 may be an elongated slit-like configuration as shown in FIG. 2 but may be of a rectangular or circular hole.

The distance from the extreme end of the spinning nozzle 1 to the communication hole 13 is preferably from 0.5 m to 2 m in order that the primary drawing is sufficiently carried out and the secondary drawing is carried out at the communication hole 13 portion.

The difference between the pressure within the high pressure chamber 11 and the pressure within the low pressure chamber 12 is preferably above 300 mm (water column), more preferably, above 800 mm. It is suggested that a pressure setting device is provided to set such a pressure difference.

The pressure setting device may be, for example, a pressurizing mechanism such as a blower 70 or a pressure-reducing mechanism such as an exhauster 71. That is, more specifically, the high pressure chamber 11 is made to be atmospheric pressure and the low pressure chamber 12 is provided with the exhauster 71 so as to form a negative pressure, whereas the high pressure chamber 11 is provided with the blower 70 so as to form a positive pressure and the low pressure chamber 12 is made to be atmospheric pressure. In the apparatus shown in FIG. 1, the high pressure chamber 11 is provided with the blower 70 to form a positive pressure, and the low pressure chamber 12 is provided with the exhauster 71 to form a negative pressure. It is to be noted that a differential pressure gauge 80 for measuring a differential pressure between the high pressure chamber 11 and the low pressure chamber 12 so that the differential pressure is measured by the differential pressure gauge 80, and if the measured value is deviated from a target value, the blower 70 or the exhauster 71 is driven to control pressure.

The hauling force at the communication hole 13 is adjusted according to the sectional area and length of the communication hole and the pressure difference.

As apparatus for realizing the drawing step, the high pressure chamber 11 and the low pressure chamber 12 as described above are not provided but an air sucker heretofore known may be used.

The air sucker is the apparatus which is provided with a fiber supply passage having a fiber inlet for receiving fibers spun by the spinning nozzle and a fiber outlet for discharging fibers, and is provided with an air feed passage having an air inlet, said air feed passage being merged with said fiber supply passage so that at said merged point, air from the air feed passage is brown out in the direction of the fiber outlet of the fiber supply passage, and the hauling force is applied to the fibers passing through the fiber supply passage due to the pressure difference between the inlet side and the outlet side of the fiber supply passage.

Figure 9:
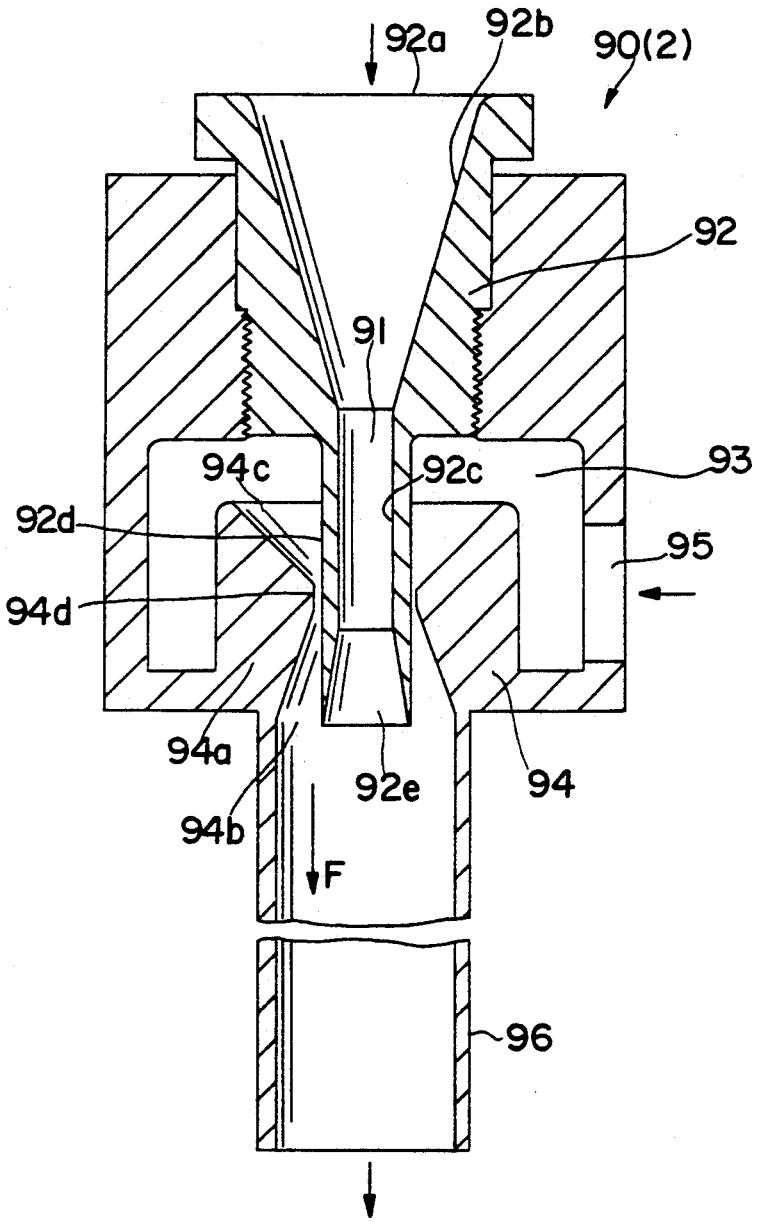
FIG. 9 is a sectional view showing one example of an air sucker.

More specifically, an air sucker 90 disclosed in Japanese Patent Publication No. 48-28386 may be used. As shown in FIG. 9, the air sucker 90 comprises a supply nozzle 92 having a fiber supply passage 91 and an air nozzle 94 connected to the nozzle 92 and having an air feed passage 93.

The supply nozzle 92 has a fiber inlet **92*a* for receiving fibers delivered from the spinning nozzle 1, and the interior continuous to the fiber inlet 92*a* comprises a tapered pipeline 92*b*** reduced in diameter to the middle portion toward the extreme end and a straight pipeline 92c having the same inside diameter from the extreme end of the tapered pipeline 92b to a fiber outlet 92e. This straight pipeline 92c is formed from a nozzle pipe 92d which is projected.

An air nozzle 94 is connected to the supply nozzle 92 so as to encircle the periphery of the extreme end of the nozzle pipe 92d. The air nozzle 94 has a blow-off nozzle 94a which surround the extreme end of the nozzle pipe 92d. A slight clearance is formed between the inner surface of the blow-off nozzle 94a and the outer surface of the nozzle pipe 92d so as to form a compression air blow-off opening 94b in the periphery of the fiber outlet 92e at the extreme end of the nozzle pipe 92d. The inner surface of the blow-off nozzle 94a is gradually reduced in diameter from the air inlet 94c side; when beyond the largest constriction 94d in the middle portion, gradually increases in diameter, and from a portion corresponding to the fiber outlet 92e, will have the same diameter.

On the other hand, a compression air inlet 95 is provided in the side of the air nozzle 94, the compression air inlet 95 being communicated with an air inlet 94c of the blow-off nozzle 94a. Air introduced into the blow-off nozzle 94a from the compression air inlet 95 assumes the highest flow velocity at the point where the air passes through the largest constriction 94d whereby air is powerfully jet out of the compression air blow-off opening 94b in a direction as indicated by arrow F to generate a pressure difference between the fiber inlet 92a and the fiber outlet 92e to powerfully draw the fibers passing near the center of the nozzle pipe 92d.

A guide pipe 96 for guiding the fiber 2 is connected in a direction of feeding the fiber of the air nozzle 94.

The fibers delivered from the guide pipe 96 are accumulated on the collecting surface of the collecting device 3 directly or through a separator for dispersing fibers to form nonwoven fabrics.

Figure 10:
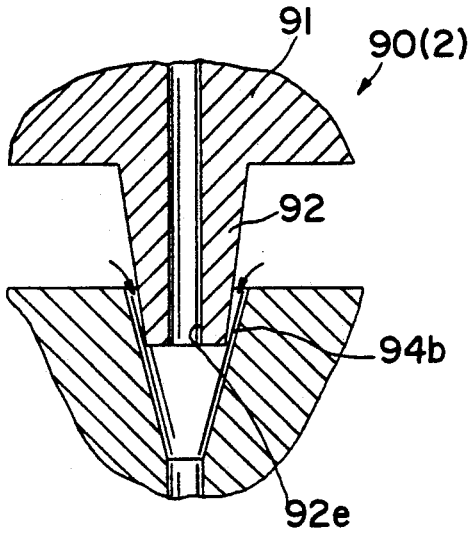
FIG. 10 is a sectional view showing a further air sucker.

An air sucker disclosed in Japanese Patent Application Laid-Open No. 63-282350 can also be used. This air sucker has the same fundamental principle as that of FIG. 9. As shown in FIG. 10, this air sucker is apparatus comprising a supply nozzle 92 having a fiber supply passage and an air nozzle 94 connected so as to surround the nozzle 92 and having an air feed passage 93. A compression air blow-off opening 94b is provided in the periphery of a fiber outlet 92e of the supply nozzle 92.

(3) Collecting Step

The collecting step will now be described.

In case of the example shown in FIG. 1, the low pressure chamber 12 is provided with a collecting device 3 which collects a group of extra fine drawn fibers obtained by drawing to adhere them to each other. An endless belt-like collecting net 60 is passed over a plurality of guide rolls 61, and an opposed collecting surface of the communication hole 13 is formed by the belt-like collecting net 60. At least one of the guide rolls 61 is driven by a driving source such as a motor not shown so as to rotate the collecting net 60. A negative pressure chamber 64 is formed behind the collecting net 60, and an air intake 72 of the exhauster 71 is connected to the negative pressure chamber 64. Thereby, not only a pressure difference is produced between the high pressure chamber 11 and the low pressure chamber 12 but also the continuous fibers stacked on the collecting net 60 can be well held on the collecting net 60.

As for examples of the collecting surface other than that described above, there can be mentioned a rotating columnar drum peripheral surface or a moving collecting surface such as a belt conveyor.

(4) Uniting Step

Finally, the uniting step will be described hereinafter.

Since the continuous fibers stacked on the collecting surface are not mutually united as they are, they are chemically or mechanically united, by conventionally well-known methods such as adhesives, heat emboss, needle punch, etc.

For example, in the FIG. 1 apparatus, a group of continuous fibers stacked on the collecting net 60 are separated from the collecting net 60, pass through a pair of heat emboss rolls 62, subjected to emboss processing to form nonwoven fabrics and wound about a winder 63.

(5) Properties of the obtained fibers

The fibers obtained by the present invention have a fineness less than 1 denier, a single-yarn strength of 2 to 6 g/denier, and a natural crimp of 5 to 30 crests/inch.

As described above, according to the present invention, it is possible to manufacture stably nonwoven fabrics from continuous fibers which is less than 1 denier in fineness and high in strength.

EMBODIMENTS

The embodiments of the present invention will be described hereinafter.

The apparatus shown in FIG. 1 was used, and as the spinning nozzle 1, the nozzle shown in FIGS. 3 to 5 was used. 450 capillary tubes 33 are aligned in a plane, which have an inside diameter of 0.3 mm and an outside diameter of 0.55 mm, extreme end of which is sharpened through 30 degrees, and which are projected by 1 mm from the lip portion 34.

When the spinning nozzle 1 is installed within the high pressure chamber 11, the distance between the extreme end of the capillary tubes and the communication hole 13 of the partitioning wall 10 was set to 1.5 m. The communication hole 13 provided in the partitioning wall 10 comprises a slit having a height of 5 mm, a width of 300 mm and a depth of 500 mm.

The high pressure chamber 11 is interiorly made to be atmospheric pressure, and the low pressure chamber 12 is reduced in pressure by the exhauster 71 to generate a pressure difference of 900 mm (water column) before and behind the communication hole 13.

As resins for nonwoven fabrics A, polypropylene of which melt flow rate is 30 g/10 min. was used. The discharge quantity of resin was 0.06 g/hole/min., and the resin was extruded at resin temperature of 280° C. As high-temperature and high-speed stream gases brown out of gas orifices, air at temperature of 280° C. and pressure of 0.5 kg/cm$^2$ was used.

In the spinning step, the speed of the fibers from the spinning nozzle 1 was 2 m/sec., and in the drawing step, the speed of the fibers in the secondary drawing caused by the passage of the communication hole 13 was approximately 15 m/sec.

The stabilized continuous spun yarns were obtained without occurrence of yarn-cutting during spinning. Drawn extra fine fibers obtained by drawing in the communication hole 13 had a fineness of 0.4 to 0.7 denier, a natural crimp of 5 crests/inch to 30 crests/inch, and a single-yarn strength of 2 to 6 g/denier in the form of a continuous yarn.

What is claimed is:

1. A method for manufacturing nonwoven fabrics comprising the steps of: spinning for obtaining a continuously drawn fiber by blowing a molten resin extruded out of a spinning nozzle by heated gases blown out of the periphery of the spinning nozzle to a place at a distance of 0.5 m to 2 m from the extreme end of said nozzle; drawing at said place for further drawing the obtained continuously drawn fiber by an air stream produced due to a pressure difference of gases; collecting for collecting the drawn continuous fiber to collect the fibers; and uniting for uniting the collected continuous fibers together to form nonwoven fabrics.

2. A method for manufacturing nonwoven fabrics according to claim 1, wherein, in the spinning step, the speed of gas flow is adjusted so that the speed of the fibers blown and moved by the gas flow is less than 20 m/sec., and is 1 m/sec. or more.

3. A method for manufacturing nonwoven fabrics according to claim 1, wherein said pressure difference is in excess of 300 mm in water column.

4. A method for manufacturing nonwoven fabrics according to claim 1, wherein in said drawing step, a high pressure chamber on the side of the spinning step and a low pressure chamber on the side of the collecting step are partitioned by a partitioning wall having a communication hole, and the fibers are drawn by a stream produced in a communication hole due to a pressure difference between the high pressure chamber and the low pressure chamber.

5. A method for manufacturing nonwoven fabrics according to claim 1, wherein the drawing step is adjusted so that the velocity of fiber is in excess of that when the drawing does not take place by 1 m/sec. or more.

6. An apparatus for manufacturing nonwoven fabrics comprising: a spinning nozzle having orifices for blowing out heated gases in the periphery of extrusion holes of molten resin and blowing the molten resin extruded out of extrusion holes by heated gases blown out of the orifices to subject the resin to primary drawing; a drawing device for subjecting a continuously drawn fiber spun from the spinning nozzle to secondary drawing at a pressure difference of gases, the extreme end of the drawing device being at a distance of 0.5 m to 2 m from the extreme end of the spinning nozzle; a collecting device for receiving the secondary drawn continuous fiber at a collecting surface to collect the fibers; and a uniting device for uniting the collected continuous fibers together to form nonwoven fabrics.

7. An apparatus for manufacturing nonwoven fabrics according to claim 6, wherein the spinning nozzle comprises a die block having a resin chamber for receiving molten resins to be extruded, a plurality of capillary tubes of which base ends are held on the die block in the state they form in a plane and communicated with the resin chamber and a gas plate which has a flat lip portion at the extreme end thereof, the extreme end of the capillary tube being held by a flat keep surface of the lip portion, orifices for blowing gases formed between said keep surface and the peripheral surface of the capillary tube, a gas chamber communicated with the gas blowing orifices formed adjacent to the die block, and a gas inlet for supplying gas into the gas chamber.

8. An apparatus for manufacturing nonwoven fabrics according to claim 6, wherein bore diameter of the extrusion hole of the spinning nozzle is preferably small, 0.6 mm to 0.1 mm.

9. An apparatus for manufacturing nonwoven fabrics according to claim 6, wherein said drawing device has a high pressure chamber and a low pressure chamber which are partitioned by a partitioning wall, said partitioning wall being provided with a communication hole to communicate the high pressure chamber with the low pressure chamber, said spinning nozzle being installed on the side of the high pressure chamber, said collecting device being installed on the side of the low pressure chamber.

10. An apparatus for manufacturing nonwoven fabrics according to claim 6, wherein said drawing device comprises an air sucker which has a fiber supply passage having a fiber inlet for receiving fibers spun by said spinning nozzle and a fiber outlet for discharging fibers received and has an air feed passage, said air feed passage being merged with said fiber supply passage, and at said merged point, air from the air feed passage is blown out in a direction of the fiber outlet of the fiber supply passage, and a hauling force is applied to the fibers passing through the fiber supply passage due to a pressure difference between the inlet and outlet of the fiber supply passage.

11. An apparatus for manufacturing nonwoven fabrics according to claim 6, wherein the collecting device has a collecting net forming the collecting surface, a negative pressure chamber is formed behind the collecting net, and an exhauster is connected to the negative pressure chamber.

* * * * *